US009677297B2

(12) United States Patent
Warner et al.

(10) Patent No.: US 9,677,297 B2
(45) Date of Patent: Jun. 13, 2017

(54) METHOD OF INSTALLATION OF A STRUCTURAL SUPPORT APPARATUS

(71) Applicant: Solid Structures, Spokane, WA (US)

(72) Inventors: James Lee Warner, Colbert, WA (US); Jensen James Lewis, Colbert, WA (US)

(73) Assignee: Solid Structures, Spokane, WA (US)

( * ) Notice: Subject to any disclaimer, the term of this patent is extended or adjusted under 35 U.S.C. 154(b) by 0 days.

(21) Appl. No.: 15/167,503

(22) Filed: May 27, 2016

(65) Prior Publication Data

US 2016/0273239 A1 Sep. 22, 2016

Related U.S. Application Data

(62) Division of application No. 14/610,825, filed on Jan. 30, 2015, now Pat. No. 9,366,052.

(51) Int. Cl.
*E04H 12/22* (2006.01)
*E02D 27/42* (2006.01)

(52) U.S. Cl.
CPC ..... *E04H 12/2284* (2013.01); *E02D 27/42* (2013.01); *E04H 12/2253* (2013.01); *E04H 12/2261* (2013.01); *E04H 12/2269* (2013.01)

(58) Field of Classification Search
CPC ..... E04H 12/2284; E04H 12/2261; E04H 12/2269; E04H 12/2253; E02D 27/42
See application file for complete search history.

(56) References Cited

U.S. PATENT DOCUMENTS 4,199,908 A * 4/1980 Teeters ..... E04H 12/2284 248/357
D260,964 S * 9/1981 Gilb ..... E04H 12/2284 D8/373
4,614,070 A * 9/1986 Idland ..... E04H 12/2253 52/295
4,666,774 A 5/1987 Christini
4,924,648 A * 5/1990 Gilb ..... E04B 1/41 52/295
5,375,384 A * 12/1994 Wolfson ..... E04B 1/0007 52/295
5,561,950 A * 10/1996 Collins ..... E02D 27/32 248/354.3
5,666,774 A * 9/1997 Commins ..... E04H 12/2253 248/188.4
5,697,190 A 12/1997 Scribner
(Continued)

OTHER PUBLICATIONS

Office action for U.S. Appl. No. 14/610,825, mailed on Feb. 4, 2016, Warner et al., "Structural Support Apparatus and Method of Installation Thereof", 10 pages.

(Continued)

*Primary Examiner* — Andrew J Triggs
(74) *Attorney, Agent, or Firm* — Lee & Hayes, PLLC

(57) ABSTRACT

A method of installing a support member includes disposing a ground plate of a support member on a ground surface. The support member includes a lift assist component that engages with a bar connected to the ground plate. The method further includes adjusting a height of upper ends of the support member by actuating the lift assist component such that the upper ends of the support member are elevated or lowered.

4 Claims, 8 Drawing Sheets

(56) References Cited

U.S. PATENT DOCUMENTS

| | | | | |
|---|---|---|---|---|
| 6,513,290 | B2 * | 2/2003 | Leek | E04B 1/2604 403/232.1 |
| 7,168,343 | B2 * | 1/2007 | Leek | B25B 13/481 52/704 |
| 7,296,501 | B2 * | 11/2007 | Leek | B25B 13/481 52/704 |
| 7,513,083 | B2 * | 4/2009 | Pryor | E02D 27/42 403/232.1 |
| D607,711 | S * | 1/2010 | Adams | E04H 12/2284 D8/354 |
| 7,677,522 | B2 * | 3/2010 | Bakos | E02D 27/42 248/354.1 |
| 8,235,346 | B2 * | 8/2012 | Bakos | E02D 27/42 248/354.1 |
| 8,959,857 | B1 * | 2/2015 | Lin | E04H 12/2261 256/65.14 |
| 9,366,052 | B1 * | 6/2016 | Warner | E04H 12/2269 |
| 2007/0267552 | A1 * | 11/2007 | Meyer | E04H 12/2276 248/156 |
| 2010/0098499 | A1 * | 4/2010 | Bakos | E04H 12/2261 405/231 |
| 2014/0115978 | A1 * | 5/2014 | Fairbairn | E02D 27/42 52/126.1 |

OTHER PUBLICATIONS

Office Action for U.S. Appl. No. 14/610,825, mailed on Sep. 28, 2015, James Lee Warner, "Structural Support Apparatus and Method of Installation Thereof", 8 pages.

* cited by examiner

METHOD OF INSTALLATION OF A STRUCTURAL SUPPORT APPARATUS

CROSS REFERENCE TO RELATED PATENT APPLICATIONS

This application is a divisional of and claims priority to U.S. patent application Ser. No. 14/610,825, filed on Jan. 30, 2015, entitled "Structural Support Apparatus and Method of Installation Thereof," which application is hereby incorporated in its entirety by reference.

BACKGROUND

A pole building or a post frame building is a building structure, made in a quick and simplified manner, which may be of multiple varieties, including barns, sheds, shops, homes, etc. Generally, the basic structure of a pole building included a framework of columns on which walls and/or an overhead shelter may be built. Traditionally, the frameworks have been formed by partially burying large poles or posts in the ground so as to make upright columns that can be framed or otherwise built up. In more recent times, in lieu of simply burying the poles, the poles or posts have been fastened to a foundation or support means, such as a concrete pad. While burying the poles provides good lateral stability, the direct exposure to soil or other stabilizing materials, such as concrete or gravel, may cause rot and decay in poles, particularly when the pole is made of wood. Therefore, instead of wood, some pole buildings implement poles cast entirely in concrete.

When constructing a pole building, one challenge faced by the builders is to ensure that the height of the poles is accurate according to the necessary grade. Further, in order to ensure stability and safety, the poles are generally buried to a predetermined depth to help prevent the structure from merely being blown over or ripped from the ground. Despite excavation capabilities, these factors present a challenge due to the differences in the natural land surface and content from place to place, even in a single space of land for the same building. Generally, a height adjustment is done by repeatedly performing a process to check the height until the height is correct. The process may include inserting a pole into an excavated hole, checking the height, and removing the pole from the hole to add or remove material under the pole. Thus, current methods of height adjustment are time-consuming and difficult.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to a structural support apparatus, which is well-suited for many uses, but particularly for pole buildings (also known as a post frame building). The disclosure is further directed to method for installing a structural support apparatus having the features discussed herein. A pole building is a building structure, made in a quick and simplified manner, which may be of multiple varieties, including barns, sheds, shops, homes, etc. Generally, the basic structure of a pole building included a framework of columns on which walls and/or an overhead shelter may be built. Traditionally, the frameworks have been formed by partially burying large poles or posts in the ground so as to make upright columns that can be framed or otherwise built up. In more recent times, in lieu of simply burying the poles, the poles or posts have been fastened to a foundation or support means, such as a concrete pad. While burying the poles provides good lateral stability, the direct exposure to soil or other stabilizing materials, such as concrete or gravel, may cause rot and decay in poles, particularly when the pole is made of wood. Therefore, instead of wood, some pole buildings implement poles cast entirely in concrete. However, this method is cumbersome and costly due, in large part, to the heavy weight of the pre-cast concrete pole.

As explained herein, a structural support apparatus according to the features depicted and described simplifies the process of adjusting the height of the support member and thus, the column thereon as well. Further, the structural support apparatus described herein improves the ease of construction and minimizes costs. Moreover, features such as the height adjustment system of the various embodiments of the structural support apparatus of this application maintain and improve the structural integrity of the pole building.

In an example, a structural support apparatus may include a height adjustment system that quickly allows a user to adjust the height without needing to remove the pole repeatedly to add or remove matter beneath the pole.

Accordingly, the structural support apparatus described herein may accurately and effectively assist a user in quickly constructing a pole building. In the following paragraphs various embodiments of a structural support apparatus including a height adjustment system are described.

Illustrative Embodiments of a Structural Support Apparatus

Figure 1:
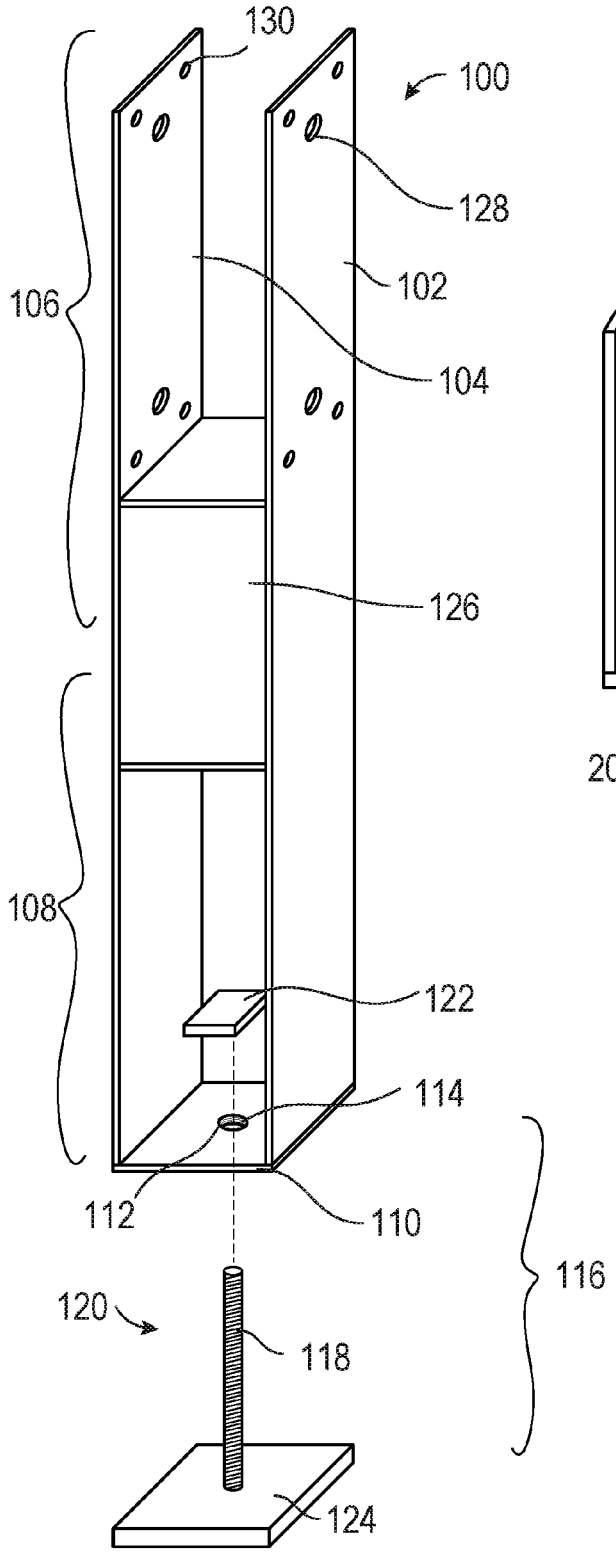
FIG. 1 illustrates an exploded isometric view of a structural support apparatus.

FIG. 1 illustrates an embodiment of a structural support apparatus 100. The structural support apparatus 100 may include a first strap 102 and a second strap 104 facing the first strap 102. Each of the first and second straps 102, 104 may be visually divided for the purpose of the discussion in the specification (or literally divided, as in FIG. 5) into an upper portion 106, which is roughly the top half of the first and second straps 102, 104, and a lower portion 108, which is roughly the bottom half of the first and second straps 102, 104. The first and second straps 102, 104 may be elongated, thin plates to which a column may be attached upon installation of the apparatus 100.

It is noted that straps, such as the first and second straps 102, 104 of this application, as well as the other elements of the structural support apparatuses described herein may be made of a material resistant to deterioration when buried in soil or surrounded by another material, such as concrete, for example. Thus, the structural support apparatuses described herein may be made of a metal, such as steel, for example, or other suitable materials.

The first and second straps 102, 104 may be secured close to each other by one or more connection members. Some of the connection members may include a base portion 110, a capped tube ("support column rest") 126, and a stiffener plate (shown as element 404 in FIG. 4). The base portion 110 may be located at a lowermost end of the structural support apparatus 100, and may anchor the first strap 102 to the second strap 104. The base portion 110 may have a hole 112. Other embodiments may not have the hole 112, as seen in FIG. 5, for example. As depicted in FIG. 1, the hole 112 may also have a threaded surface 114.

Furthermore, the structural support apparatus 100 may include a height adjustment system 116. In some embodiments, the height adjustment system 116 may include a bar 118, a lift assist component 120, an obstruction 122, and a ground plate 124. In the embodiment of FIG. 1, the bar 118 may be connected to the ground plate 124 and may pass through the hole 112 of the base portion 110. The height adjustment system 116 may further include the lift assist component 120, which may be the threaded surface of the bar 118. Threaded surface 114 of the hole in the base plate 110 may be sized to accommodate the threaded surface on the bar 118. A first end of the bar 118 may be attached to the ground plate 124. Accordingly, with these components, the height of the structural support apparatus 100 may be easily adjusted by rotating the upper portion 106 of the straps 102, 104 about the axis of the bar 118 so that the straps 102, 104 are raised or lowered as desired, by engaging the threaded surface 114 with the bar 118.

While not a necessity, a second end of the bar 118 may be attached to an obstruction 122, which may help prevent the bar 118 from threading completely out of the base portion 110.

The structural support apparatus 100 may also include another connection member that is a support column rest 126. The support column rest 126 may securely anchor the first strap 102 to the second strap 104. It is noted that the support column rest 126 is depicted as extending along the first and second straps 102,104 and is thus longer than the base portion 110, however, the base portion 110 is not limited to the plate-like shape shown in FIG. 1.

Moreover, the structural support apparatus 100 may include holes 128 and 130 in a corresponding pattern in the first and second straps 102, 104. In particular, the patterned holes 128, 130 may be located in the respective upper portions of the first and second straps 102, 104 in such a position so as to create a specific moment, which is beneficial for the integrity of the structure. For example, in an embodiment (not drawn to scale in the Figures), there may be two ¼ inch holes, located ¾ inch below the top of the straps and ¾ inches inward from each side, respectively. Another pair of ¼ inch holes that may be found ¾ inches in from a side, may also be located 23¼ inches down from a top of the straps. Additionally, a pair of ¾ inch holes may be located in the center line of the straps, at 3 and 21 inches, respectively.

Figure 2:
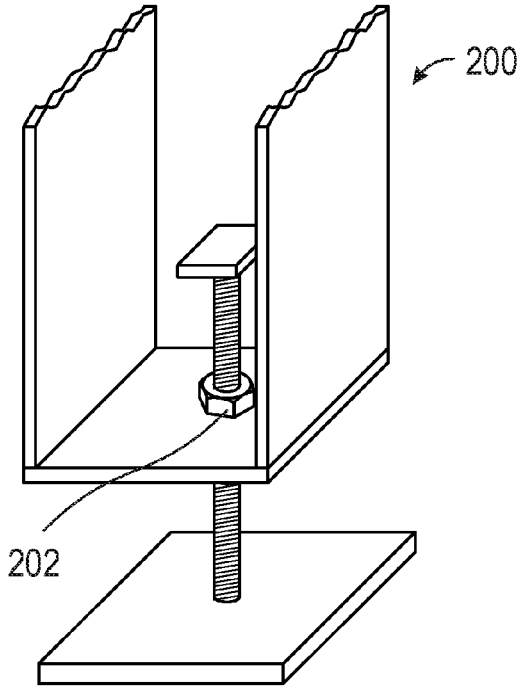
FIG. 2 illustrates an assembled isometric view of the lower portion of an alternative embodiment of a structural support apparatus.

With respect to the portion of the structural support apparatus 200 shown in FIG. 2, although the height adjustment system 116 (of FIG. 1), may be similar to the components height adjustment system in FIG. 2, the structural support apparatus 200 may include a threaded nut 202, instead of the threaded surface 114 on the hole 112 itself, as in FIG. 1. Thus, similar to FIG. 1, the height of the structural support apparatus 100 may be easily adjusted by rotating the upper portion 106 of the straps 102, 104. Additionally, despite the presence of the obstruction 122 shown in FIGS. 1 and 2, it is contemplated that the bar of the structural support apparatus may be used and/or built without an obstruction 122, as seen in FIGS. 4-11.

Figure 3:
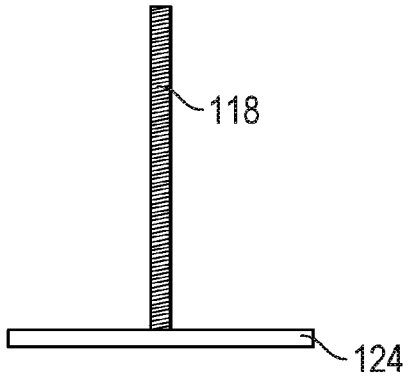
FIG. 3 illustrates a side view of an example base portion.

FIG. 3 merely shows the side view profile of the bar 118 attached to the ground plate 124. Inasmuch as FIG. 3 shows a side profile, it is noted that the ground plate 124 may be one of multiple shapes including circular, square, triangular, etc.

Figure 4:
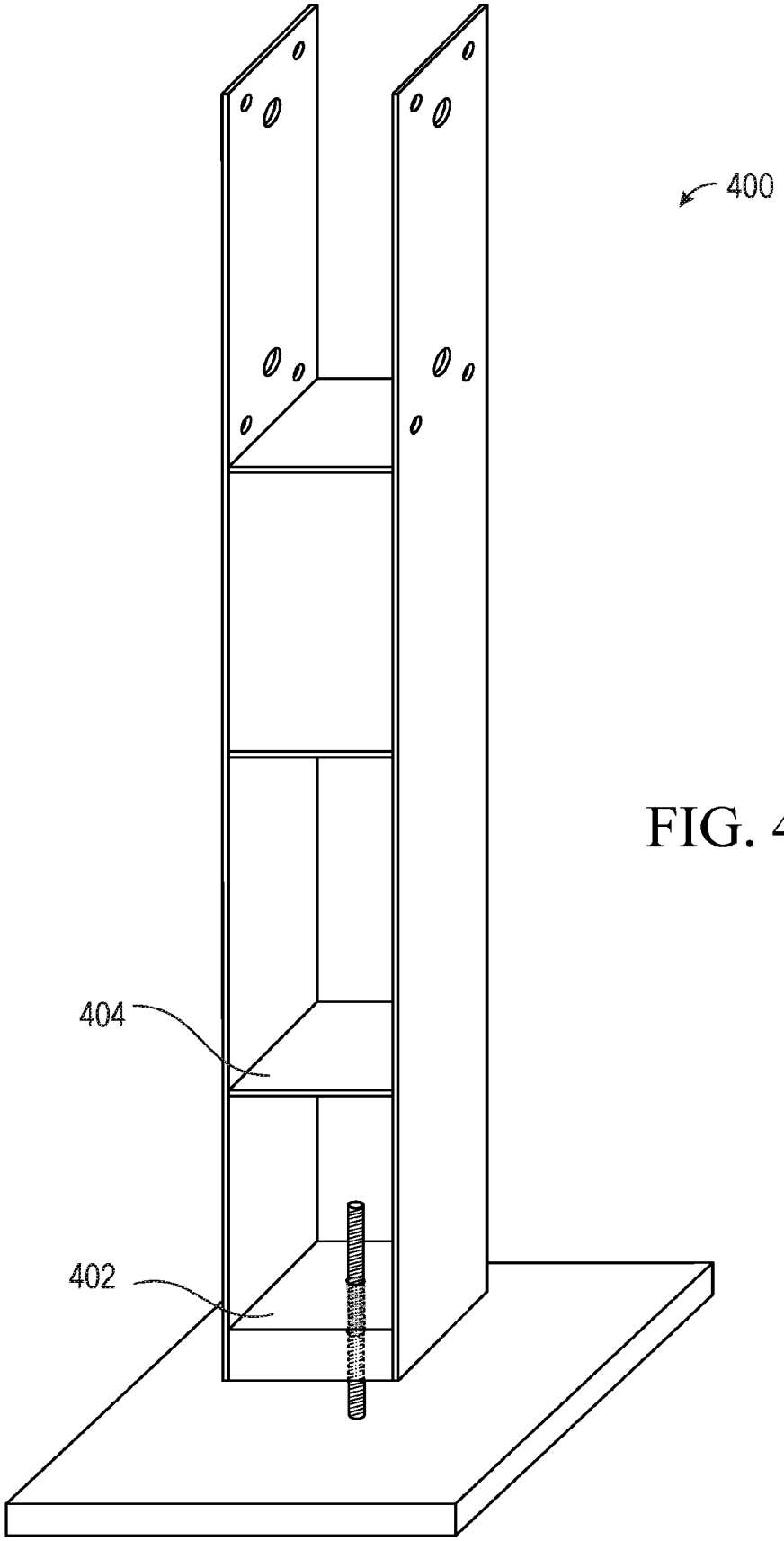
FIG. 4 illustrates an isometric view of another alternative embodiment of a structural support apparatus.
Figure 5:
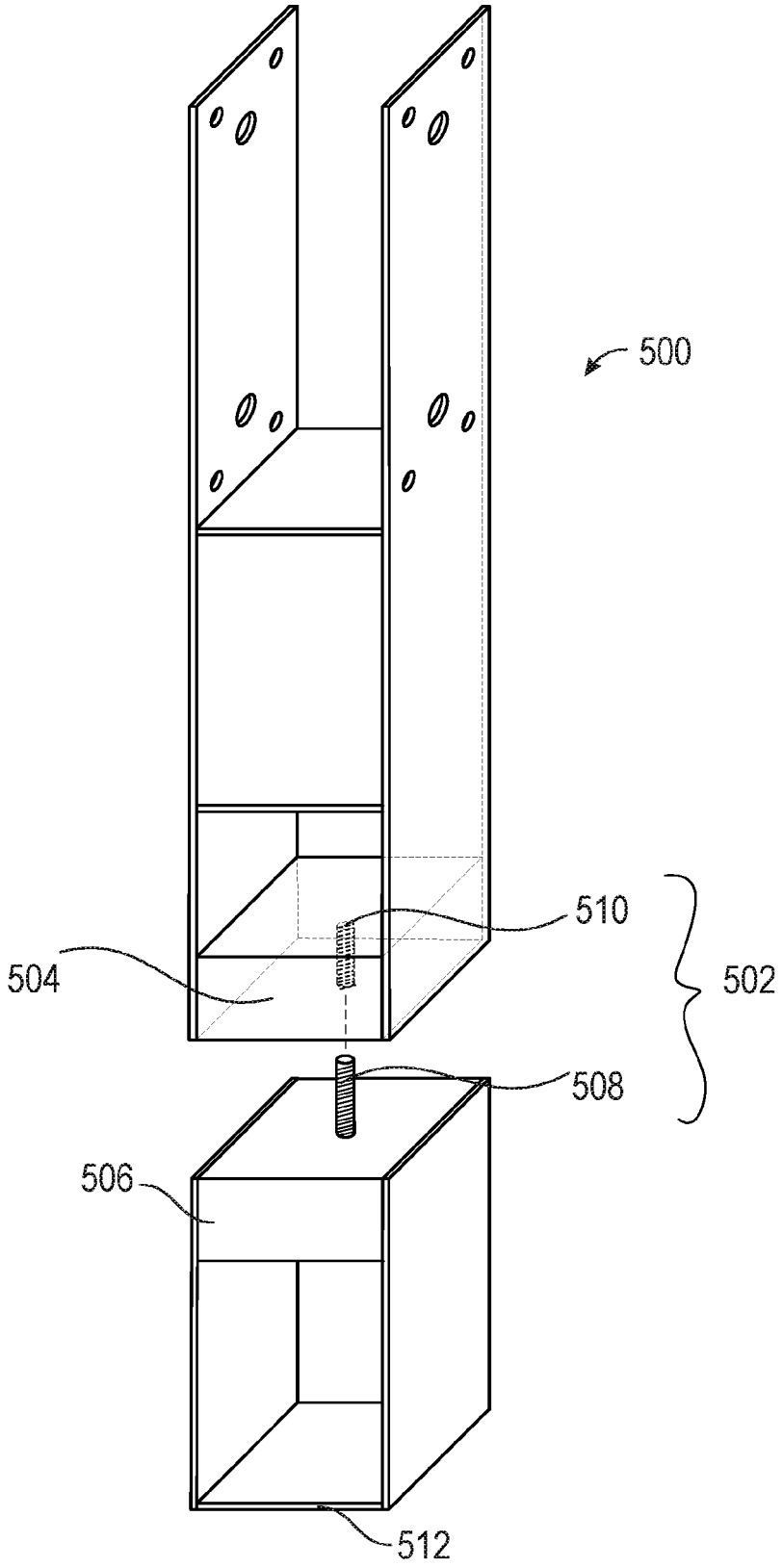
FIG. 5 illustrates an isometric view of yet another alternative embodiment of a structural support apparatus.

The structural support apparatus 400 depicted in FIG. 4 may be distinguished from the structural support apparatus 100 in FIG. 1, for at least the fact that the structural support apparatus 400 includes a stiffener plate 404. The stiffener plate 404 may anchor the pair of straps together, and may be located between above the base portion 402. One benefit gained by including a stiffener plate 404 is that, upon filling in the hole with concrete, gravel, or another material, the stiffener plate 404 provides additional surface area over which the filler spreads so as to increase the force with which the apparatus is secured under the ground.

Another difference between the features in FIGS. 1 and 4 is that the base portion 402 is depicted as being much thicker than the base portion 110, shown in FIG. 1. As such, the base plate 402 includes a large surface area of threads with which the bar engages, thereby providing greater stability for the apparatus during installation.

Unlike the structural support apparatus 400, the height adjustment system of the embodiment in FIG. 5 is not located in the base portion 512. Instead, FIG. 5 shows a block strap connector 502, which may include an upper part 504 and a lower part 506. A bar 508 may be fixed in place in the lower or upper parts 504, 506, or it may be loosely threaded in either as well. The threaded hole 510 depicted in the upper part 504 accommodates the bar 508, such that the height of the structural support apparatus 500 may be easily adjusted by rotating the upper portion of the straps.

Figure 6A:
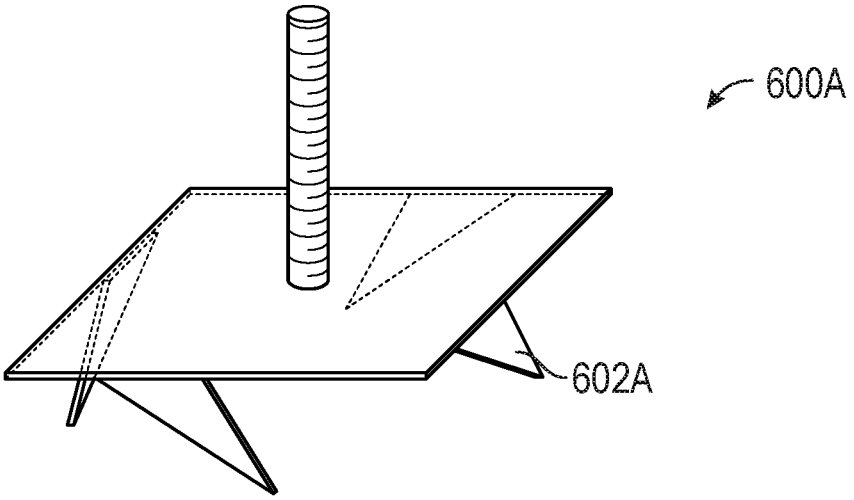
FIG. 6A illustrates an isometric view an example embodiment of a ground plate.
Figure 6B:
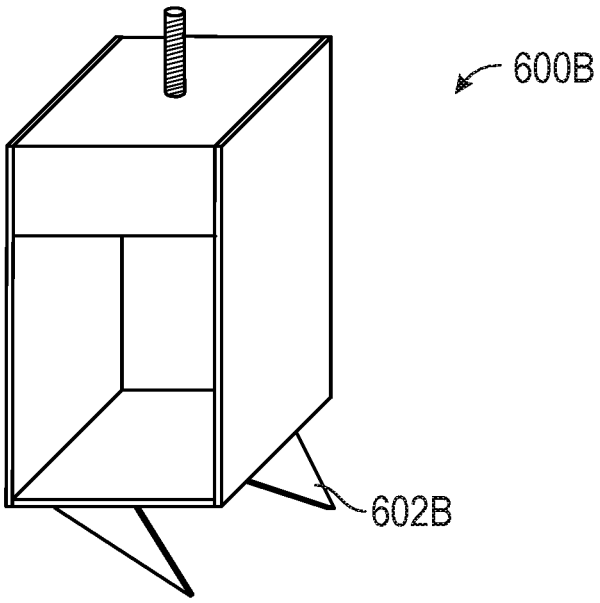
FIG. 6B illustrates an isometric view an example embodiment of a base portion.

FIGS. 6A and 6B illustrate variations of how the structural support apparatus may be secured to the ground surface to avoid slipping, especially if an embodiment that adjust via rotation is used. Regardless, the stabilizing projections may be able to help stabilize any of the embodiments. For example, in FIG. 6A, a ground plate 600A is shown with stabilizing projections 602A extending from a bottom side of the ground plate 600A. Similarly, in FIG. 6B, the lower portion of a structural support apparatus 600B is shown with similar stabilizing projections 602B. The shape of the stabilizing projections 602A, 602B can vary greatly. For example, stabilizing projections may be a spike shape, a tooth shape, or a claw shape. Additionally, the position of the stabilizing projections 602A, 602B may be oriented toward a lateral direction that is opposite a tangential direction of the rotation used to raise a height of the apparatus so as to counteract a rotational force of raising the height of the structural support apparatus. Thus, the stabilizing projections may pierce the ground surface. Further, the stabilizing projections may extend in a direction transverse to a direction of extension of the base portion between the straps and extends away from the straps.

FIGS. 7A-11 depict various additional embodiments of a height adjustment system of a structural support apparatus. Note that only a portion of the respective structural support apparatuses are shown in FIGS. 7A-11.

Figure 7A:
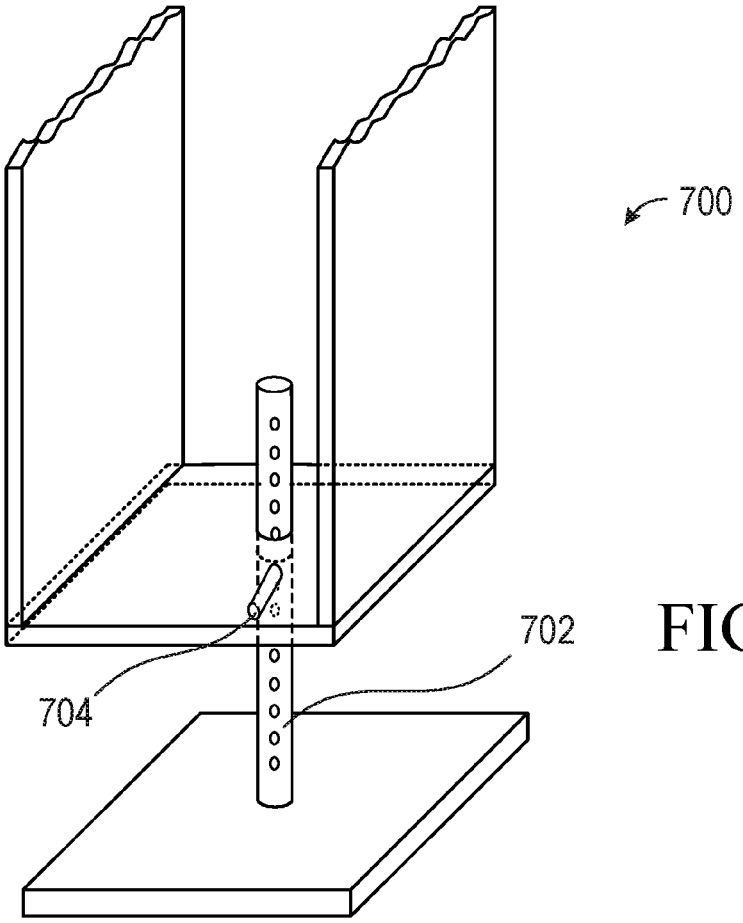
FIG. 7A illustrates an isometric view of the lower portion of another alternative embodiment of a structural support apparatus.
Figure 7B:
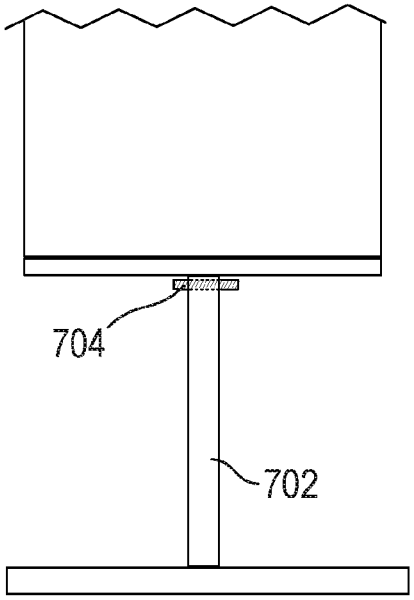
FIG. 7B illustrates a side view of the apparatus shown in FIG. 7A.

FIG. 7A shows a portion of a structural support apparatus 700 that has a bar 702, which includes a plurality of through holes. The bar 702 may extend through the base portion of the structural support apparatus and the lift assist component, a pin 704, may be sized to fit in the holes in the bar 702. As such, the structural support apparatus 700 can be raised and lowered to a desired height by simply removing the pin 704, placing the structural support apparatus 700 at the desired height, and inserting the pin 704 into the hole in the bar located immediately beneath the base portion of the structural support apparatus 700. In this manner, the weight of the apparatus may rest on the pin 704 and hold the correct height. FIG. 7B shows a side view of the structural support apparatus depicted in FIG. 7A.

Figure 8:
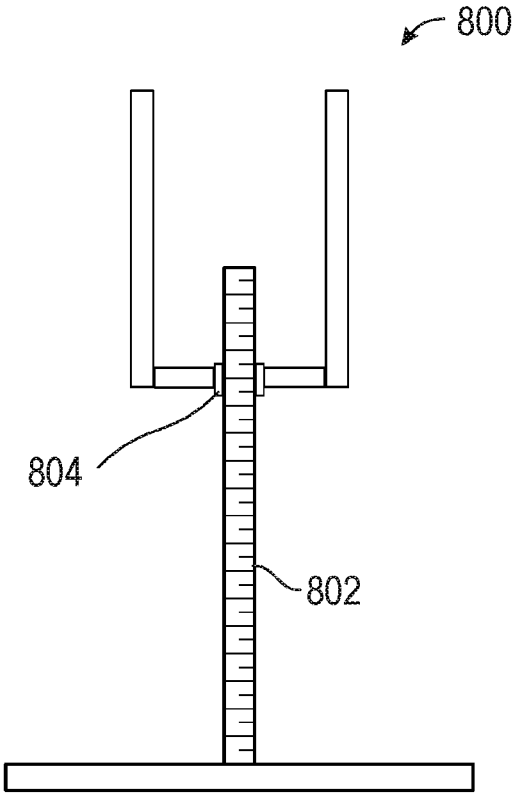
FIG. 8 illustrates a side view of another example embodiment of the lower portion of a structural support apparatus.

FIG. 8 depicts a portion of a structural support apparatus 800 with a bar 802. The structural support apparatus 800 may further include a lift assist component 804, which may be a compression sleeve 804 disposed within a hole in the base member. The height adjustment system functions via a compression fit of the sleeve 804 surrounding the bar 802. Thus, in the embodiment in FIG. 8, the height of the structural support apparatus 800 is adjusted by simply sliding the structural support apparatus 800 up or down along the bar 802 by forcing the bar 802 through the compression sleeve 804.

Figure 9:
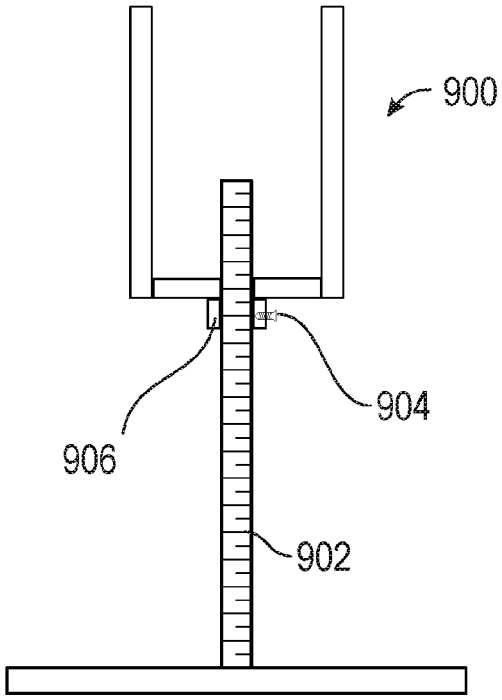
FIG. 9 illustrates a side view of yet another example embodiment of the lower portion of a structural support apparatus.

In an alternative embodiment shown in FIG. 9, the height adjustment system of the structural support apparatus 900 may include a bar 902 that may include notches or grooves and a lift assist component including a set screw 904 and a collar 906 in which the set screw may be inserted. The alternating short and long lines seen on the bar 902 (and similarly on the bar 1002) may represent either notches or grooves. The notches or grooves may be angled to a specific direction so as to be more effective for maintaining a specific desired height. The height of the structural support apparatus 900 may be adjusted by raising or lowering the apparatus 900 along the bar 902 to a desired height, and then sliding the collar 906 up to the base portion of the structural support apparatus 900, as depicted in FIG. 9. Then, the set screw 904 may be tightened into the collar 906 to have the set screw 906 tightly clamp the collar 906 against the bar 902 in compression. The set screw 904 may be either inserted into a notch or a groove (or an unaltered side wall) on the bar 902 through the collar 906, or it may clamp the collar 906 down around the bar 902.

Figure 10:
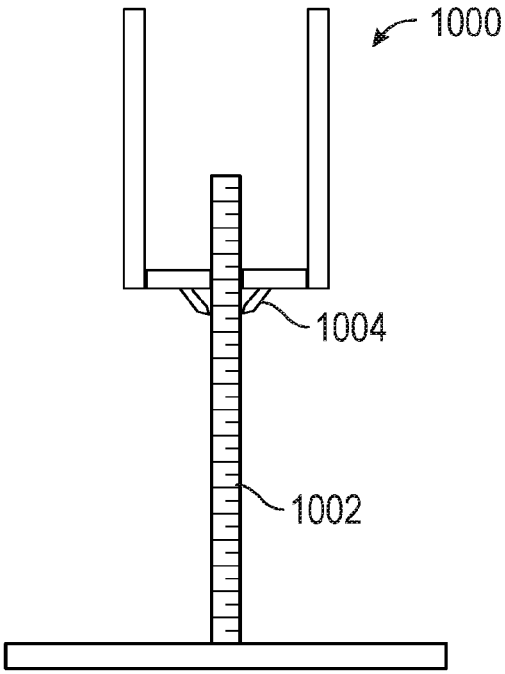
FIG. 10 illustrates a side view of a different example embodiment of the lower portion of a structural support apparatus.

In yet another alternative embodiment of a structural support apparatus 1000, FIG. 10 depicts a height adjustment system that includes a bar 1002, having grooves or notches, and a lift assist component, which is one or more spring-loaded, hinged wedge members 1004. As depicted in FIG. 10, the wedge members 1004 are angled from the base portion of the structural support apparatus 1000 so as to point downward against the notches or grooves in the bar 1002. More specifically, the hinged wedge members 1004 open downwardly toward a ground surface and are hinged so as to close against a side of the bar 1002 and engage the notches under a force of the weight of the apparatus 1000. In this manner, engagement between the wedge members 1004 and the bar 1002 make a height adjustment by allowing the wedge members 1004 to flex downwardly and loosely while raising the straps, and yet locking the wedge members 1004 in place against the bar 1002, which prevents the wedge members 1004 from flexing upwardly and prevents downward movement of the straps.

Though not explicitly shown, the wedge members 1004 may be spring-loaded by spring that extends from the base portion of the structural support apparatus 1000 to a top side of the wedge member so as to create an upward force against the bar 1002.

Figure 11:
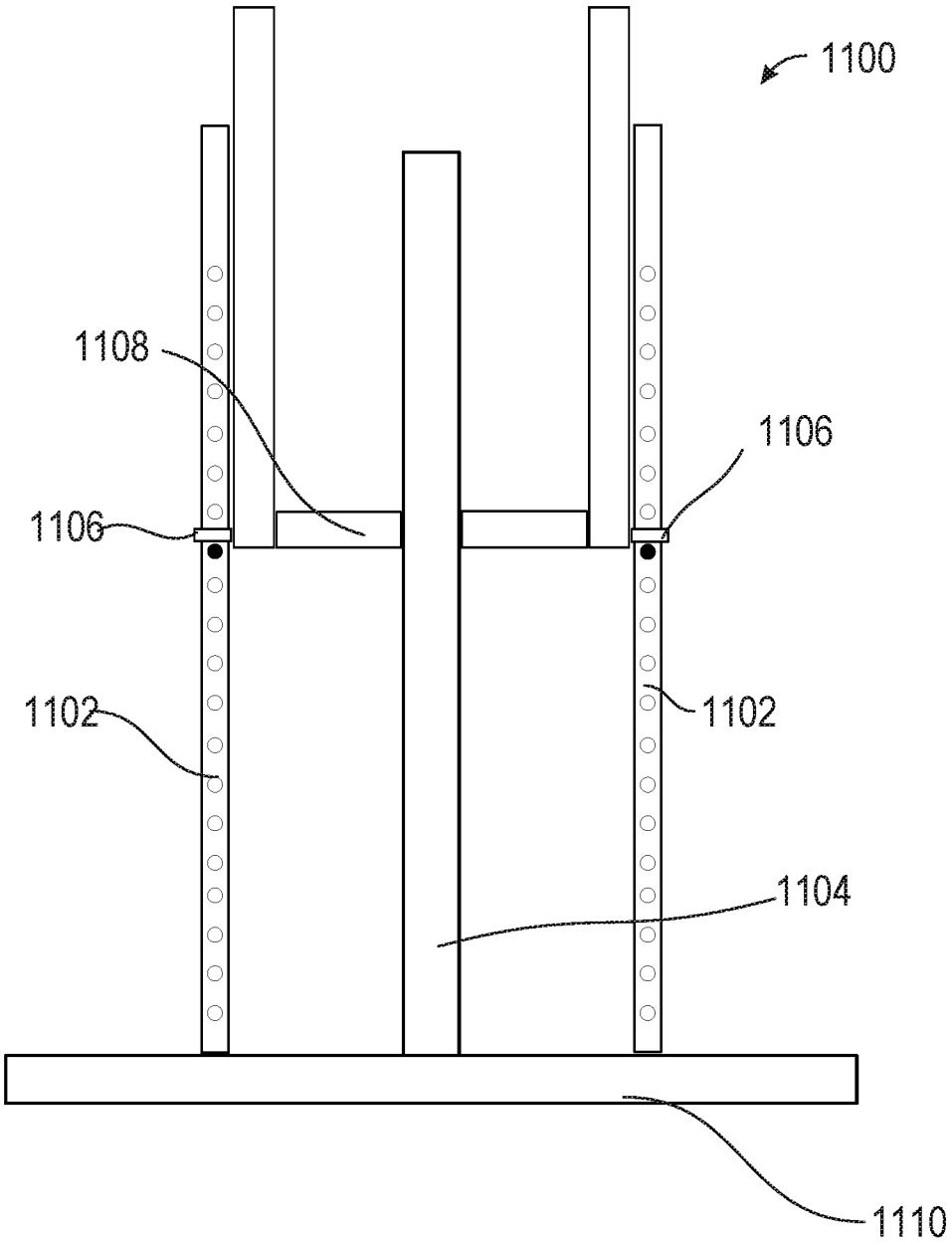
FIG. 11 illustrates a side view of an example embodiment of the lower portion of a structural support apparatus where the bar is outside of the straps.

The height adjustment system in the embodiment of the structural support apparatus 1100 in FIG. 11 is similar to the height adjustment system depicted in FIG. 7. However, in the embodiment depicted in FIG. 11, there are two bars 1102 (though only one may be needed), each of which has a plurality of through holes along the length of the bar 1102. The height adjustment system may further include a central stabilizing member 1104 that extends through the base portion 1108, and at least one pin rest (bracket) 1106, which may be attached to either one or both sides of the straps in the structural support apparatus 1100. The bars 1102 extend respectively through the pin rests 1106 on the outside of the straps of the structural support apparatus 1100. Furthermore, the bars 1102 may rest against or may be fixed in position to the ground plate 1110. Therefore, in order to adjust the height of the structural support apparatus 1100, the apparatus may be raised or lowered along a length of the bars 1102. Then, when located at the desired height, a pin 1112 may be inserted into the hole just beneath the pin rests 1106, so that the pin rests sit on the pin to prevent downward movement of the structural support apparatus 1100.

In an alternative embodiment, (not depicted) the height adjustment system of the structural support apparatus 1100 may function without the base portion 1108 or the central stabilizing member 1104. Thus, the structural support 1100 may be raised or lowered and supported only by the bars 1102 sliding in the pin rests 1106 and being fixed to the ground plate 1110.

Figure 12:
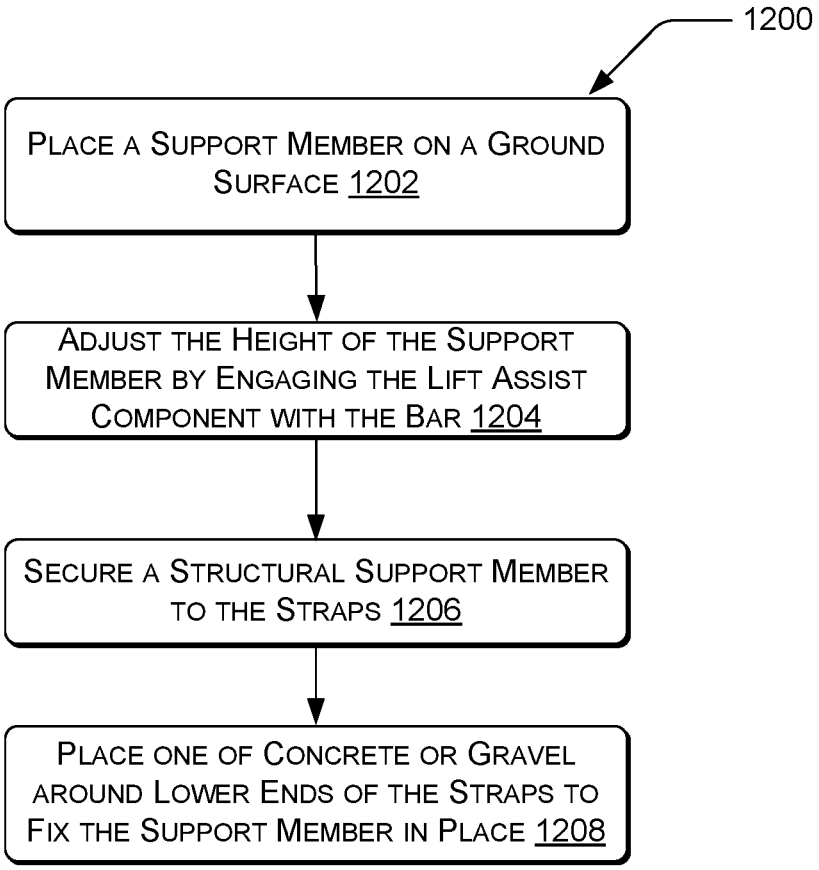
FIG. 12 illustrates a flowchart of a method of installing the structural support apparatus.

Illustrative Embodiments of a Method of Installing a Structural Support Apparatus In FIG. 12, a flowchart of a method of installing a support member 1200 is shown. In particular, a support member may be placed on a ground surface 1202. The support member may be any of the embodiments described above. The height of the support member is adjusted 1204 by engaging the lift assist component with the bar. This may be achieved using any of the methods above. A structural support member is secured to the straps 1206. Additionally, generally one of concrete or gravel is placed around the lower ends of the straps to fix the support member in place. In order to secure a structural support column to the straps, the support column is rested on the support column rest, and the support column is secured between the straps via fastening hardware inserted into holes in upper ends of the straps.

Another embodiment of a method of installing a structural support apparatus may include pouring a footing in a hole, and then bolting the base portion or ground plate of the structural support apparatus to the footing. The height may then be adjusted to set the apparatus to grade and the post or column may be fixed to the support apparatus. The footing may vary in size and the support apparatus may vary in height depending on the job. The apparatus may further have the ability to be locked to prevent turning, for example, if threaded, there may be a nut on the top and bottom.

In yet another embodiment, the apparatus may be used to set manufactured homes. For example, the support apparatus may be flipped upside down with no straps so that the height adjustment system is facing up. The height adjustment system may be welded or bolted to the metal frame of the manufactured home. The apparatus may also be bolted to a footing or wet set it in the ground.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A method of installing a support member, comprising:

placing the support member on a ground surface, the support member including a pair of straps facing each other, one or more connection members disposed between the straps and anchoring the straps at a fixed distance from each other to accommodate a structural support column therebetween, the one or more connection members including a support column rest and a base portion, and a height adjustment system including at least one bar disposed adjacent to at least one of the straps, and a lift assist component that engages with the bar such that, in an orientation where the straps extend vertically with respect to a horizontal plane, a distance between the horizontal plane and a top of the support column rest is adjustable via engagement between the lift assist component and the bar, wherein the pair of straps include through holes extending through respective upper ends thereof at a position above the support column rest and on an end opposite the base portion, and wherein the support column rest is spaced apart from the base portion by the space between the straps into which the at least one bar extends; and adjusting a height of the support member by engaging the lift assist component with the bar.

2. The method according to claim 1, wherein the adjusting the height of the support member includes rotating upper portions of the straps about an axis of the bar, the bar being a threaded rod.

3. The method according to claim 1, further comprising securing a structural support column to the straps including resting the support column on the support column rest, and securing the support column between the straps via fastening hardware inserted into the holes in the upper ends of the straps.

4. The method according to claim 1, further comprising placing at least one of concrete or gravel around lower ends of the straps to fix the support member in place.

* * * * *